United States Patent [19]

Stringham et al.

[11] 4,218,497

[45] Aug. 19, 1980

[54] METHOD FOR DIE CUTTING A PLASTIC WEB

[75] Inventors: Leroy O. Stringham, Clearwater, Fla.; Michael J. Lawrence, Chicago, Ill.

[73] Assignee: Champion International Corporation, Stamford, Conn.

[21] Appl. No.: 40,502

[22] Filed: May 21, 1979

[51] Int. Cl.[2] ..... B05D 3/12

[52] U.S. Cl. ..... 427/289; 118/37

[58] Field of Search ..... 427/289, 293; 118/37, 118/38, 39, 40, 41, 42; 29/424

[56] References Cited

U.S. PATENT DOCUMENTS

| | | | |
|---|---|---|---|
| 3,465,627 | 9/1969 | Vigneault | 83/684 X |
| 3,850,059 | 11/1974 | Kang | 83/669 X |

*Primary Examiner*—Evan K. Lawrence

*Attorney, Agent, or Firm*—Evelyn M. Sommer

[57] ABSTRACT

An improved method for die cutting a plastic or paper web which is used in the formation of the trays, pouches and such composite structures for containing food or other consumable products, or is used in the formation of hospital or medical products, for instance filters employed in medical procedures, is effective to provide smooth cut edges of the tray without any hair-like sliver members. In the process where a rotary die cutter is employed and includes a support member for supporting the web to be cut, a frangible but non-splintered coating is first applied to the surface of the web coming in contact with the support member. The web is conveyed between the rotatable die cutter and the support member and the die cutter cuts the web by penetrating the entire thickness thereof, however, the cutter blade does not come in contact with the support member. The impact of the die cutter blade causes a crack in the coating such that separation of the cut portions of the web is effected along the crack by the shearing action caused by the movement of the web. The resulting cut edge of the finished plastic or paper product is smooth, and does not include any hair-like slivers.

13 Claims, No Drawings

METHOD FOR DIE CUTTING A PLASTIC WEB

BACKGROUND OF THE INVENTION

The subject invention relates to an improved method for die cutting a plastic or paper web. The invention is applicable in the formation of plastic or paper trays, pouches and such composite structures for containing food and hospital or medical products. A preferred method of cutting is the high speed continuous die cutting machinery commonly used in the paper industry. In a typical operation, a plastic or paper web is continuously conveyed in a horizontal direction where it passes between a rotary die cutter and an anvil or support member. At desired places on the web, the rotary cutter is activated such that it penetrates the web. In order to avoid damage to the anvil member, which is typically a rotatable roller member, the cutter is set such that the blade portion thereof does not penetrate the entire thickness of the web. Rather, the blade penetrates the web only to an intermediate portion thereof, with the remaining portion of the web, typically having a thickness on the order of 0.0001–0.005 inches, being broken or shattered by the impact of the cutter blade together with the shearing force effected by the horizontal motion of the web. It has been found that as a result of this cutting procedure, the edge of the web formed by the cutter blade is clean while the edge of the web formed by the shattering or shearing of the web is rough, and includes a plurality of hair-like paper or plastic slivers. When a package formed from the specific web is filled with a food or other consumable product, there is often a tendency of the hair-like plastic or paper slivers to detach from the web and become embedded in the consumable product. It will be appreciated that such an effect is highly undesirable. Where the web is made of a paper material, die cutting of the material may also form paper dust in addition to paper slivers. This is of critical concern especially where the die cut paper is to form, for example, a blood filter used in apparatus employed in a hospital operating room. Any slivers or dust could, of course, be potentially dangerous if present in a hospital product.

Accordingly, it is an object of the subject invention to provide an improved method of die cutting a plastic or paper web which employs standard automatic die cutting machinery in which the edges of the cut webs are smooth without any hair-like sliver members.

It is another object of the invention to provide an improved method of die cutting a plastic or paper sheet with any form of die cutting apparatus such as rotary, reciprocal or flat bed.

It is a further object of the subject invention to provide an improved method having the above characteristics which is simple yet efficient and reliable.

SUMMARY OF THE INVENTION

In accordance with the above cited objectives, the subject invention provides an improved method for continuously die cutting a plastic or paper web which includes the steps of conveying the web to a die cutter disposed adjacent one surface of the web, there being a support member disposed on the opposite surface of the web aligned with the cutter for supporting the web, and cutting the web at selected areas. According to the subject invention, the improvement comprises the steps of applying to a portion of the surface of the web disposed away from the die cutter a frangible, but non-splintering coating that contacts the support member, and cutting the web such that the entire thickness thereof is penetrated by the cutter. The web coating has a thickness such that the blade of the die cutter, while penetrating the entire thickness of the web, does not come in contact with the support member. The coating is preferably transparent and may be applied either by a printing press, a separate coating operation, an inline coater on the cutting apparatus, or an inline coater while printing of the web.

DESCRIPTION OF THE PREFERRED EMBODIMENTS

Figure 2:
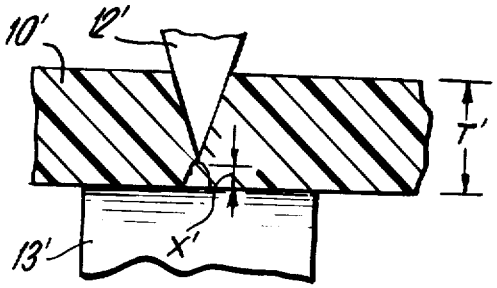
(PRIOR ART) FIG. 2
FIG. 2 is a schematic cross-section of a known method of die cutting a plastic or paper web illustrating the depth to which the cutter blade penetreates the web during the cutting procedure of the known method.
Figure 3:
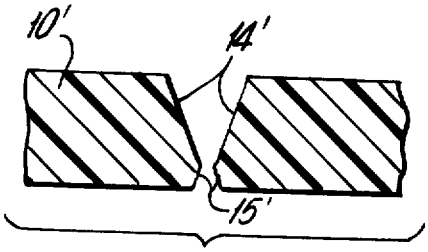
(PRIOR ART) FIG. 3
FIG. 3 is a schematic cross-section of the plastic or paper web after it has been cut in accordance with the known method.

Referring to FIGS. 1–4, a known method for continuously die cutting a plastic or paper web comprises the conveying of the web 10' in a horizontal direction, such that it passes between a rotary die cutter 11' and an anvil or support member 13', which is typically a rotatable roller member. The web may be conveyed by any known conveyance means. At selected times, the die cutter 11' is activated such that the blade portion 12 thereof penetrates the thickness of the web 10'. As shown in FIG. 2, the blade 12' of the cutter does not penetrate the entire thickness T' of the web. Rather, it penetrates the web only to an intermediate portion thereof such that a thickness X' of the web remains uncut by the blade. As indicated above, it is necessary that the blade 12' does not penetrate the entire thickness of the web so as to prevent the blade from coming in contact with anvil member 13' and damaging same. Referring to FIG. 3, it will be noted that because the cutter 11' is set so as to penetrate only a portion of the web 10', the web is cut so as to include edge portions 14' which have been cut by the blade 12', and edge portions 15' which are formed as a result of the impact of blade 12' and the shearing action effected on the web by its motion in a horizontal direction. It will be further noted that edge portions 14' which have been cut by the cutter blade are smooth while edge portions 15' are rough.

Figure 4:
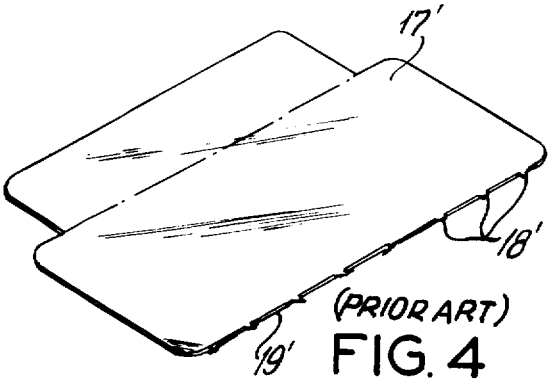
(PRIOR ART) FIG. 4
FIG. 4 is the perspective view of a plastic or paper sheet after it has been cut in accordance with a known method.

The effect of this can be seen in FIG. 4 with respect to the finished product 17 that has been cut from the web. More particularly, referring to FIG. 4, it will be noted that the cut edge 19' of member 17' includes a plurality of hair-like sliver members 18'. As discussed above, such hair-like slivers are undesirable in that they tend to sever from the plastic or paper member and become embedded in consumable products.

Figure 1:
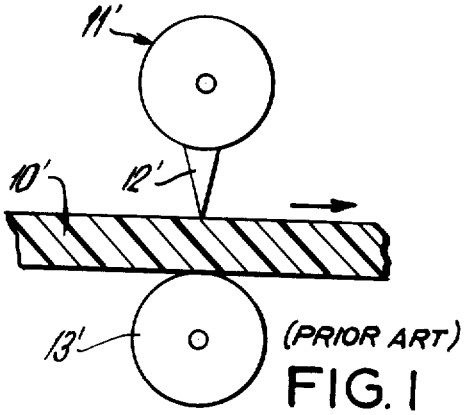
(PRIOR ART) FIG. 1
FIG. 1 is a schematic cross-section of a known method of die cutting a plastic or paper web.
Figure 5:
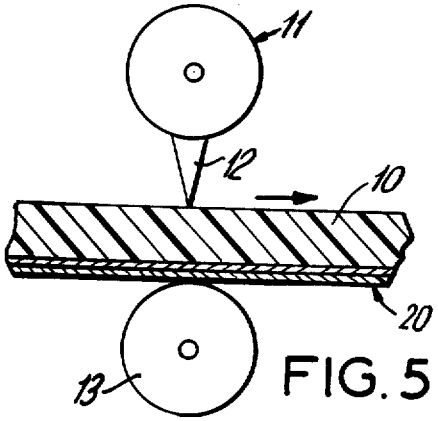
FIG. 5 is a schematic cross-sectional view of the method of die cutting a plastic or paper web in accordance with the subject invention.
Figure 6:
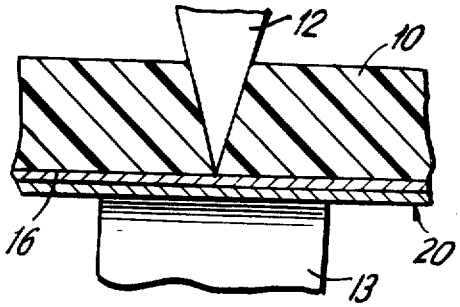
FIG.6 is a schematic cross-sectional view of the method for die cutting a plastic or paper web in accordance with the subject invention illustrating the penetration of the cutter blade through the thickness of the web.
Figure 7:
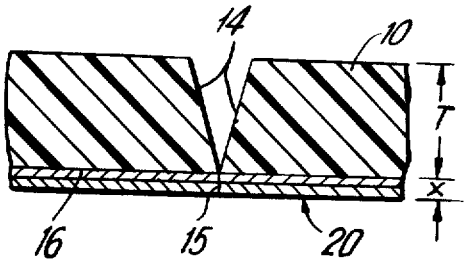
FIG. 7 is a schematic cross-section of the web which has been cut in accordance with the method of the subject invention.
Figure 8:
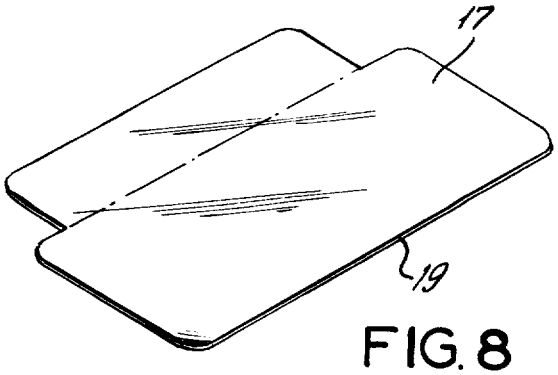
FIG. 8 is a perspective view of the plastic or paper sheet that has been cut in accordance with the method of the subject invention.

Referring now to FIGS. 5–8, there is illustrated the method of cutting a plastic or paper web in accordance with the subject invention. As indicated in FIGS. 5 and 6, the machinery for cutting the web includes a die cutter 11 and a support member 13, which is aligned with the cutter and spaced therefrom such that the plastic web 10 may pass therebetween for cutting. The web 10 may be conveyed in a horizontal direction by any known conveyance means. Referring to FIGS. 5–7, it will be noted that in accordance with the method of the subject invention, the web 10 is specially treated before it is conveyed to die cutter 11. More particularly, the surface of the web 10 disposed away from the cutter 11, i.e., the bottom surface 16 of the web 10 as illustrated in the figures, is treated with a coating material which is frangible, but non-splintering. Preferably, the coating is a transparent, non-splintering material. For example, the coating may be a suitable plastic material. In accordance with the subject invention, the coating 20 is preferably applied only to the portions of the web bottom surface 16 where the web is to be cut, rather than to the entire bottom surface. Of course for certain applications, it may be preferable to coat the entire surface of the web. In addition, in accordance with the subject method, coating 20 has a thickness X such that the blade 12 of the cutter may penetrate the entire thickness T of the web without damaging the surface of anvil member 13. For a typical plastic or paper web having a thickness on the order of 0.007–0.008 inches, the coating may have a thickness on the order of 0.001–0.002 inches. It will be appreciated, however, that the coating thickness X may vary in accordance with the particular material from which the web 10 is made, as well as the thickness thereof. The subject process may be employed in conjunction with plastic or paper webs of a wide range of thicknesses, on the order of 0.003–0.050 inches, with the thickness of the coating being in the range of 0.0001–0.005 inches. To a large extent, the thickness of the coating is a function of the effeciency of the die cutter (whether rotary, reciprocal or flat bed) and the quality of the machining of the die cutter. A very thin coating of 0.0001 inches may be sufficient on a very small, perfectly machined die cutter, whereas on a rather large and less efficiently machined die cutter, a coating on the order of 0.001–0.002 inches may be required. For even larger and more inefficient equipment, it may be necessary to apply a coating on the order of 0.005 inches, either in a pattern or an over-all coated form. In addition, for webs made of certain plastic materials, it may be preferable to reinforce the first coating by applying a second coating to the web, over the first coating. Referring now to FIGS. 6 and 7, it will be noted that the blade portion 12 of the cutter penetrates the entire thickness T of the web with the point of the blade being spaced apart from and insulated from the anvil member 13 by coating 20. As shown in FIG. 7, cut edges 14 of the web which have been cut by the die cutter, extend the entire thickness of the web, and are smooth. In addition, it will be noted that the impact of the blade causes a crack 15 in coating 20. The separation of the cut portions of the web is effected along crack 15 by the shearing action caused by the movement of the web. Referring to FIG. 8, it will be noted that the cut edge 19 of the finished plastic or paper product 17 is smooth and does not include any hair-like slivers as exist as a result of the prior art methods.

Certain changes or modifications in the practice of the present invention can be readily entered into without substantially departing from the intended spirit and scope. Therefore, it is to be fully understood that the invention is not to be limited or in any way restricted by the preferred embodiments in the drawing of the foregoing specification. Rather the scope of this invention is to be interpreted and construed in light of what is set forth and delineated in the appended claims.

What is claimed is:

1. An improved method for continuously die cutting a plastic or paper web including the step of conveying the web to a cutter member disposed adjacent one surface of the web, there being a support member disposed adjacent the opposite surface of the web aligned with the cutter member for supporting the web, the improvement comprising the steps of applying to a portion of the surface of the web coming in contact with said support member, a frangible, but non-splintering coating before the web reaches the cutter; and cutting the web by penetrating the entire thickness thereof, said coating contacting the support member and having a thickness such that the cutter, while penetrating the entire thickness of the web, does not come into contact with said support member.

2. A method as recited in claim 1 in which said coating is a plastic material.

3. A method as recited in claim 1 in which said coating is transparent.

4. A method as recited in claim 1 in which the coating is applied by an inline coater disposed upstream of said cutter member.

5. A method as recited in claim 1 in which the cutter member is a rotary die cutter.

6. A method as recited in claim 1 in which the cutter member is a reciprocal die cutter.

7. A method as recited in claim 1 in which the cutter member is a flat bed die cutter.

8. An improved method for continuously die cutting a plastic web having a thickness on the order of 0.007–0.008 inches including the step of conveying the web in a horizontal direction to a rotary die cutter disposed adjacent the top surface of the web, there being a support member disposed adjacent the bottom surface of the web aligned with the cutter for supporting the web, the improvement comprising the steps of applying a portion of the bottom surface of the web a frangible, but non-slintering transparent coating before the web reaches the die cutter; and cutting the web by penetrating the entire thickness thereof, said coating contacting the support member and having a thickness on the order of 0.001–0.002 inches whereby the cutter, while penetrating the entire thickness of the web, does not come in contact with said support member and the cut edges formed in the web are smooth.

9. An improved method for continuously die cutting a plastic web having a thickness including the step of conveying the web in a horizontal direction to a rotary die cutter disposed adjacent the top surface of the web, there being a support member disposed adjacent the bottom surface of the web aligned with the cutter for supporting the web, the improvement comprising the steps of applying to a portion of the bottom surface of the web a first frangible, but non-splintering transparent coating before the web reaches the die cutter; applying a second frangible, but non-splintering transparent coating to the bottom surface of the web, over said first coating before the web reaches the die cutter; and cutting the web by penetrating the entire thickness thereof, said second coating contacting the support member and each of said coatings having a thickness such that the cutter, while penetrating the entire thickness of the web, does not come in contact with said support member and the cut edges formed in the web are smooth.

10. A method as recited in claim 9 in which the coating is applied by an inline coater disposed upstream of said cutter member.

11. A method as recited in claim 9 in which each of said coatings has a thickness on the order of 0.001–0.005 inches.

12. A method as recited in claim 9 in which said first and second coatings are a plastic material.

13. A method as recited in claim 9 in which said first and second coatings are transparent.

* * * * *